United States Patent [19]

Seragnoli

[11] 3,947,017

[45] Mar. 30, 1976

[54] APPARATUS FOR SEPARATING SHEETS, PARTICULARLY CARDBOARD BLANKS FROM A PILE

[75] Inventor: Enzo Seragnoli, Bologna, Italy

[73] Assignee: G. D Societa Per Azioni, Italy

[22] Filed: Nov. 8, 1974

[21] Appl. No.: 522,297

[30] Foreign Application Priority Data

Nov. 21, 1973 Italy ..... 3529/73

[52] U.S. Cl. ..... 271/99; 214/8.5 D; 271/165

[51] Int. Cl.[2] ..... B65H 3/62

[58] Field of Search ..... 271/146, 165, 166, 133, 271/134, 135, 221, 222, 12, 13, 99–102; 214/8.5 B, 8.5 D

[56] References Cited

UNITED STATES PATENTS

| | | | |
|---|---|---|---|
| 1,395,232 | 10/1921 | Kronquest | 271/165 |
| 1,633,937 | 6/1927 | Ford | 271/146 X |
| 1,957,318 | 5/1934 | Bush | 271/166 X |

*Primary Examiner*—Evon C. Blunk
*Assistant Examiner*—Bruce H. Stoner, Jr.
*Attorney, Agent, or Firm*—Robert E. Burns; Emmanuel J. Lobato; Bruce L. Adams

[57] ABSTRACT

A device for downwardly separating sheets, particularly cardboard blanks, from a pile of sheets or blanks, in rapid succession, by suction means, comprises a first and a second pusher system, one on one side and the other on the other side of the pile of sheets or blanks, at different heights. The two pusher systems are moved against respective sides of the pile so as to cause the individual superposed sheets or blanks to undergo alternate, lateral displacements along their mutual contact planes.

12 Claims, 2 Drawing Figures

APPARATUS FOR SEPARATING SHEETS, PARTICULARLY CARDBOARD BLANKS FROM A PILE

BACKGROUND OF THE INVENTION

This invention relates to a device for separating sheets, particularly cardboard blanks, to be fed individually to machines for packing cigarettes in packets of the hinge lid type, from piles of such sheets or blanks.

DESCRIPTION OF THE PRIOR ART

Cardboard blanks or cuttings of a similar material are, as is known, supplied to machines for packing cigarettes in packets of the hinge lid type. Such machines can process the blanks in rapid succession. However, difficulties have been encountered due to the relative thickness of the blanks (usually cardboard, or cardboard laminated with layers of a plastic or metallic material or similar on one or both sides, etcetera); the height of the pile (which causes notable pressure to be applied to the lower layers of the pile) the fact that the blanks normally have burr on their edges; and the way in which their habitually glassy surfaces stick tightly to one another. Due to such factors the blanks, when stacked, constitute almost a monolithic block. Therefore, in a supply system of the nature wherein suction means are employed, it often happens in actual practice that considerable difficulty is experienced in downwardly separating successive individual blanks, mainly in rapid succession, at the foot of the pile.

With a view to overcoming this difficulty, it has been proposed to use a container or magazine arranged so that it sloped with respect to the vertical and having one lateral wall movable in such a way as to allow it to be set at a different angle towards the inside of the said container.

This aimed at increasing the capacity of the container, to decrease the pressure applied by the pile of blanks on its lower layers, and by setting the above mentioned movable wall at a given angle, to create a system with which to separate the individual blanks at the base of the stack at a speed to suit their rhythmic removal in succession from the base thereof.

Another proposal to overcome the aforementioned difficulty, and to effect an increase in the supply potential, envisages (as also discussed in patent application Ser. No. 476,305 filed June 14, 1974 by the same applicant as herein) an apparatus structured in such a way that it operates at the base of a vertical pile of blanks maintained continuously, at an almost constant level, to enable suction means rhythmically to remove in a definite and efficient way the individual blanks at a speed to suit the maximum operating speed of high output speed wrapping or packeting machines.

SUMMARY OF THE INVENTION

In conformity with what has been said above, that is to say, with the intention of enabling individual sheets or blanks to be removed in rapid succession from the foot of a pile and of effecting an increase in the supply potential, one object of the present invention is to make available a device able to separate the sheets or blanks, in proximity of the base of the pile, to enable the individual blanks to be properly removed in rapid succession.

Another object of the present invention is to create a device able to achieve the foregoing and to guarantee that prior to being removed by the suction means, the individual sheets or blanks are set in a predetermined position against an adjustable stop.

These and other objects are attained by the new device which comprises a first pressure member or pusher placed on one side of the pile of sheets or blanks; a second pressure member or pusher placed on the opposite side to the first side, below the first pressure member or pusher with respect to the movement of the sheets or blanks towards the removal point of the sheets or blanks from the pile; and means for moving the first and second pressure members or pushers against and away from the respective sides of the pile so as to cause the individual superposed sheets or blanks to undergo alternate displacements along their mutual contact planes.

BRIEF DESCRIPTION OF THE DRAWINGS

Further characteristics and advantages will emerge more clearly from the following detailed description of a preferred but not the sole form of embodiment for the device according to the invention, illustrated purely as a non-limiting example on the accompanying drawings, in which.

DESCRIPTION OF THE PREFERRED EMBODIMENT

A chute contains and loosely (see FIG. 2), slidingly, downwardly guides the sheets or blanks 1 to be separated by the device forming the subject of the present invention, prior to their being individually removed and deposited on the conveyor B, below, which carries them in successive steps to the wrapping or packeting machines where they are used. This chute is of a type that can be adjusted in capacity, in two right angle directions. The chute essentially consists of four uprights 2, formed by angle bars connected together in an adjustable fashion by any known means, and of a fixed part 3 which provides a bottom support structure for the complete assembly through, for example, blocks 4 on part 3.

The blanks 1 are supplied to the inside of the chute A either manually or automatically, for example, by means of the apparatus forming the subject of the previously mentioned patent application in the name of the same applicant as herein.

Figure 1:
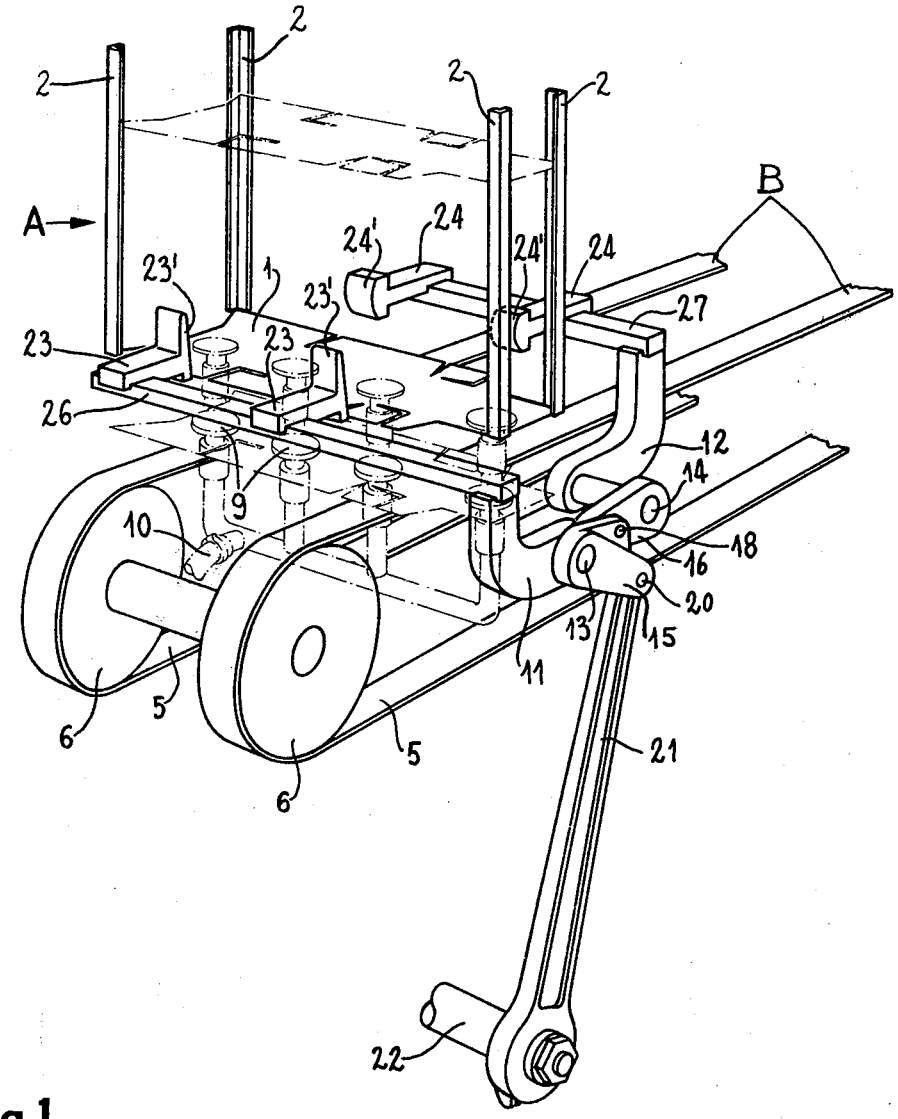
FIG. 1 shows, in a diagrammatic form, a perspective view of the new device.

The conveyor B is of what is known as the pocket type, that is to say, it is provided with compartments, each holding an individual blank 1 and, in the example illustrated, it consists essentially of a plurality of belts 5 wound in sealed ring form around idling pulleys 6, only two of which are visible in FIG. 1.

Figure 2:
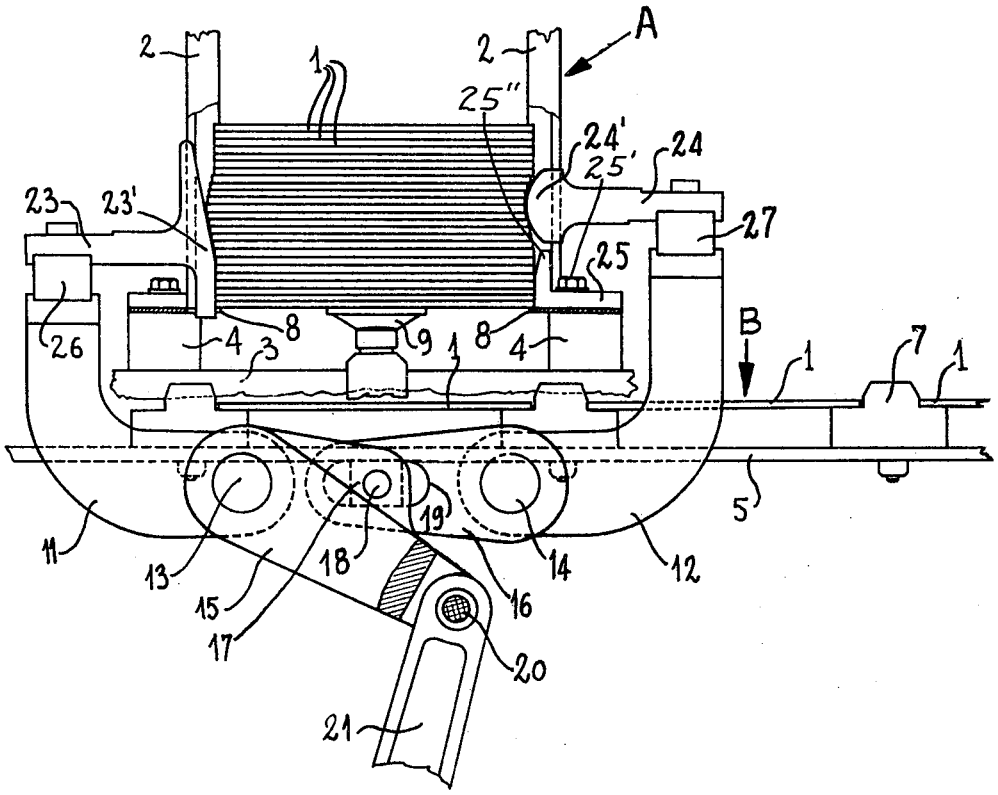
FIG. 2 shows, in greater detail, a front elevation of the device.

The belts 5 are transversely interlinked by means of bars 7 shown only in FIG. 2. Each bar has a T cross section, upside down when the belt and bar are directly below the chute, so that a pocket for a blank 1 is created by every two successive bars 7.

At a level corresponding to the base of chute A there are fillets 8, carried by the blocks 4. These fillets project towards the inside of the chute for a short distance, providing support teeth for the pile of the packet blanks 1.

The blanks 1, are removed individually in a rhythmic fashion from the foot of the pile and are deposited therebelow in the pockets of the conveyor B which carries them in successive steps to the wrapping or packeting machine not shown on the accompanying drawings.

The aforementioned rhythmic removal of the blanks 1 is carried out by a suction device of a known type which essentially comprises a plurality of suction pads 9 disposed for a reciprocating vertical to-and-fro motion and connected to a suction source (not shown on the accompanying drawings) through a hose 10 (see FIG. 1)

As stated previously, due to the relative thickness of the blanks (usually cardboard, or cardboard laminated with layers of a plastic or metallic material or similar on one or both sides, etcetera), the height of the pile in the chute A which causes notable pressure to be applied to the lower layers of the pile, the fact that the blanks normally have burr on their edges, and the way in which their habitually glassy surfaces stick tightly to one another, they, when stacked, constitute what is almost a monolithic block and thus it often happens in actual practice that considerable difficulty is experienced at the foot of the pile in separating the individual blanks in rapid succession, for them to be transferred on to the conveyor B and carried to the packeting machine.

In order to overcome these difficulties, the present invention insures that the individual blanks 1 are laterally shifted, in the lower part of the pile, thereby enabling the suction transfer means to operate under the best conditions.

This is done by a separating device which comprises, in the embodiment illustrated, two elbow shaped members 11 and 12, having spindles 13 and 14, respectively, in end portions below the chute A, and having free end portions extending upwards on opposite sides of chute A, as best shown in FIG. 2.

The illustrated spindles 13 and 14, are oscillatably carried by the support structure of the assembly. They are interconnected by a toggle device which comprises two levers 15 and 16 joined together by a sliding block 17. This block, as shown in FIG. 2, has a pin 18 fixed to the lever 15 and guided so that it slides in a slot 19 in the lever 16.

The free end of the lever 15 is articulated at 20 to the head of a connecting rod 21, the foot of which is mounted on a shaft 22 (see FIG. 1) so as to oscillate the two levers, rhythmically, somewhat like scissors, in a direct, multiple or sub-multiple ratio with the movement of the suction pads 9 used to remove the individual blanks 1 from the foot of the pile.

The free ends of the elbow shaped members 11 and 12 have mounted there on horizontal rods 26 and 27, respectively, each of which, in turn, has mounted on it and spaced along it a plurality of pressure members or pushers 23 and 24, respectively.

These members 23 and 24 extend inwards, from opposite sides, to the chute A and, as shown, slightly into the same. The free end of each pusher 24 terminates in a head 24', the surface of which facing the pile of blanks 1 is arcuate and has sufficient vertical extension to contact a group of blanks 1 in the lower part of the pile, as shown. The free end of each pusher 23 terminates in heads 23', having a surface of similar vertical extension facing the pile of blanks 1, but which, unlike the surface of heads 24' of the members 24, extends vertically in its lower part. Heads 24' have, at their top a final section which slopes slightly outwards with respect to the chute A. As clearly shown in FIG. 2, the heads 23' are disposed slightly below the heads 24'.

Below the members 24, the blocks 4 carry a stop 25 which can be adjusted in a fixed position, by bolt 25; so as to allow the blanks 1 to be set in a predetermined position at the time they are being removed by the suction pads 9. Preferably the stop faces the pile with a vertical surface having an outwardly sloping, upper portion 25'', as shown.

A rhythmic scissor movement, alternately toward and away from one another, is given to the interconnected levers 15, 16, shafts 13, 14 and members 24 and 23 by means of the connecting rod 21 through the above described toggle device. As a result, and with the arcuate heads 24' of the members 24, a lateral sliding movement is given to the successive blanks 1 as they gradually drop downwards inside the lower part of the chute A in which they are, as mentioned contained and loosely guided, while with the needs 23' of the members 23 the blanks are rhythmically, laterally, slidingly carried back to a position where they are set against the fixed stop 25. The blanks are then rhythmically downwardly removed from this set position by the suction pads 9, through a suitable opening flanked by parts of the bottom structure 3, as indicated by FIG. 2 and are deposited, each in a compartment in the conveyor B below, in which they are carried in successive steps to the packeting machine.

In practice, this rhythmic lateral sliding of the blanks at the base of the pile has made it possible to overcome the considerable difficulties encountered to date in removing the individual blanks in synchronism with the movement in successive steps of the conveyor B and thus with the wrapping or packeting machine.

What is claimed is:

1. Apparatus for separating sheets from a pile, comprising: a first pusher located opposite a lower part of one side of a pile of sheets; a second pusher located opposite a lower part of the opposite side of the pile, below the first pusher; power means for moving the first and second pushers against and away from the respective sides of the pile in lateral directions approximately along mutual contact planes of the sheets to slightly laterally shift mutually superposed sheets, in and relative to the pile; and suction means located below the pile and disposed to engage, and to downwardly separate from the pile, successive lowermost ones of the shifted sheets.

2. Apparatus according to claim 1 in which said power means are disposed for moving the first and second pushers in oscillating movements.

3. Apparatus according to claim 2 in which said power means are disposed for moving the first and second pushers simultaneously in the approximate way in which scissors move.

4. Apparatus for feeding cardboard sheets, comprising: a chute receptive of a pile of cardboard sheets in which pile the sheets overlie one another and have flat planes of mutual contact, the chute having open sides exposing edges of the sheets; a first pusher located opposite a lower part of one open side of the chute; a second pusher located opposite a lower part of the opposite open side of the chute, below the first pusher, power means for moving the first and second pushers against and away from the respective sides of the chute in lateral directions approximately along said planes of contact of the sheets to engage edges of the sheets and to slightly laterally shift mutually superposed sheets, in and relative to the chute; and suction means located below the chute and disposed to engage and to downwardly remove from the chute, successive lowermost ones of the sheets.

5. Apparatus according to claim 4 in which said sheets have loose sliding fit with the chute.

6. Apparatus according to claim 1 in which one of the pushers has an arcuate profile facing the chute.

7. Apparatus according to claim 6 in which the other pusher has a generally flat vertical profile.

8. Apparatus according to claim 7 in which the generally vertical profile of said other pusher has an upper portion slightly sloping outwardly with respect to the chute.

9. Apparatus according to claim 4, wherein each of said pushers comprises a plurality of pusher heads spaced apart along the respective side of the chute.

10. Apparatus according to claim 4, including a fixed stop member at the bottom of the chute opposite the second pusher.

11. Apparatus according to claim 10, wherein the fixed stop member is adjustably spaced from the opposite pusher.

12. Apparatus according to claim 11, in which the stop member has a vertical surface facing the pile, which surface has an upper portion sloping outwardly with respect to the chute.

* * * * *